US009358615B2

(12) United States Patent
Tang

(10) Patent No.: US 9,358,615 B2
(45) Date of Patent: Jun. 7, 2016

(54) METAL PARTICLE MANUFACTURING SYSTEM

(71) Applicant: Gold Nanotech, Inc., Taipei (TW)

(72) Inventor: James Tang, Taipei (TW)

(73) Assignee: Gold Nanotech, Inc., Taipei (TW)

( * ) Notice: Subject to any disclaimer, the term of this patent is extended or adjusted under 35 U.S.C. 154(b) by 228 days.

(21) Appl. No.: 14/158,871

(22) Filed: Jan. 20, 2014

(65) Prior Publication Data

US 2015/0202688 A1 Jul. 23, 2015

(51) Int. Cl.
*B22F 9/14* (2006.01)
*F27D 99/00* (2010.01)

(52) U.S. Cl.
CPC ..... *B22F 9/14* (2013.01); *F27D 99/0001* (2013.01); *F27D 2099/0028* (2013.01); *F27D 2099/0031* (2013.01)

(58) Field of Classification Search
CPC ..... B22F 9/14; F27D 99/0001
USPC ..... 266/202
See application file for complete search history.

(56) References Cited

U.S. PATENT DOCUMENTS 4,642,207 A * 2/1987 Uda ..... B01J 15/00 264/10
4,812,166 A * 3/1989 Saiki ..... B01J 12/002 219/121.37
4,889,665 A * 12/1989 Uda ..... B01J 15/00 264/10

* cited by examiner

*Primary Examiner* — Scott Kastler
(74) *Attorney, Agent, or Firm* — C. G. Mersereau; Nikolai & Mersereau, P.A.

(57) ABSTRACT

A metal particle manufacturing system includes: a first airtight container, in which a metal film is placed and conveyed; a plasma melting chamber for heating and melting the metal film into ultrafine particle metal; a second airtight container for cooling and suspending the ultrafine particle metal for collection and being taken out; and a circulating conveyor belt for providing conveying channels between the first airtight container, the plasma melting chamber and the second airtight container. Airtight channels are provided to cover between the first airtight container, the plasma melting chamber and the second airtight container. With this implementation, the highly pure ultrafine particle metal with the purity reaching 99.99% can be obtained.

8 Claims, 3 Drawing Sheets

METAL PARTICLE MANUFACTURING SYSTEM

BACKGROUND OF THE INVENTION

1. Field of the Invention

The invention relates to a method of manufacturing metal particles, and more particularly to a novel manufacturing process for processing a thinned metal film into particle structures.

2. Description of the Prior Art

Conventionally, methods for producing a metal film or powder are performed by way of rolling, cutting, dissolving-spraying, grinding or substrate plating that are well known in the art. Also, the methods for preparing ultrafine particle metal particles may be classified into: (a) a laser melting method; (b) a chemical reduction method; and (c) a gas-phase synthesis method. The chemical reduction method is the simplest and most popular method among the three methods. In the chemical reduction method, a metal salt is utilized as a precursor, and suitable reductant and dispersant are selected and synthesized into a nanometer structure in an aqueous solution, wherein the dispersant may be a polymeric material, such as polymeric polyacrylic acid (PAA) or polyvinylpyrrolidone (PVP), to control the particle diameter and the suspended dispersion. Although this method can manufacture the nano-scale particle, it is very difficult to obtain the pure metal material.

As mentioned hereinabove, how to obtain the metal films with different thicknesses and the fine metal powder more easily and to achieve the use of the highly pure metal powder or the decorative film is the problem to be solved by this invention.

In view of the associated problems induced by the defects of the prior art, the present inventor has paid attention to the research and development according to the experience and the technology in manufacturing the associated products for many years, and thus developed this metal particle manufacturing system and method to further enhance the industrial competition ability and the added value.

SUMMARY OF THE INVENTION

An object of the invention is to provide a metal particle manufacturing system for obtaining metal films with different thicknesses and the fine metal powder more easily and for achieving the use of the highly pure metal powder or the decorative film.

To achieve the above-identified object, the invention provides a metal particle manufacturing system different from the prior art. The system includes a first airtight container, a plasma melting chamber, a second airtight container and a circulating conveyor belt.

The first airtight container has an inlet, an inert gas inlet and a pressure relief valve. The inlet, through which a metal film may pass, may be opened and hermetically closed. Air is pumped out of the first airtight container through the inert gas inlet, and an inert gas is pumped into the first airtight container through the inert gas inlet. The pressure relief valve provides a pressure relief function to prevent a pressure of the first airtight container from getting too high.

A magnetron for generating a plasma source in the plasma melting chamber is disposed to melt the metal film into ultrafine particle metal.

The second airtight container includes an outlet, a cooling processor and a pressure relief valve. The outlet, through which the ultrafine particle metal may be taken out, may be opened and closed. The cooling processor provides a cooling process and suspends the ultrafine particle metal for collection. The pressure relief valve provides a pressure relief function to prevent the pressure of the second airtight container from getting too high.

The circulating conveyor belt provides connections and conveying channels between the first airtight container, the plasma melting chamber and the second airtight container. Airtight channels are provided to cover between the first airtight container, the plasma melting chamber and the second airtight container. Also, the circulating conveyor belt may be in the form of multiple pipelines or self-rotating satellite disks on which the metal film is placed to facilitate the uniform micro-wave melting process.

Regarding the implementation of this system, the highly pure metal material is processed to form the metal film placed into the first airtight container with the inert gas. Then, the airtight circulating conveyor belt conveys the metal film into the plasma melting chamber, in which the metal film is heated and sintered by micro-waves and then melted to form the ultrafine particle metal. Next, the circulating conveyor belt conveys the ultrafine particle metal into the second airtight container. After cooling by the cooling processor, the type suspended in the liquid is obtained. Finally, the suspended ultrafine particle metal is collected to obtain the required ultrafine particle metal.

The detailed contents and technology of the metal particle manufacturing system of the invention will be described in the following.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
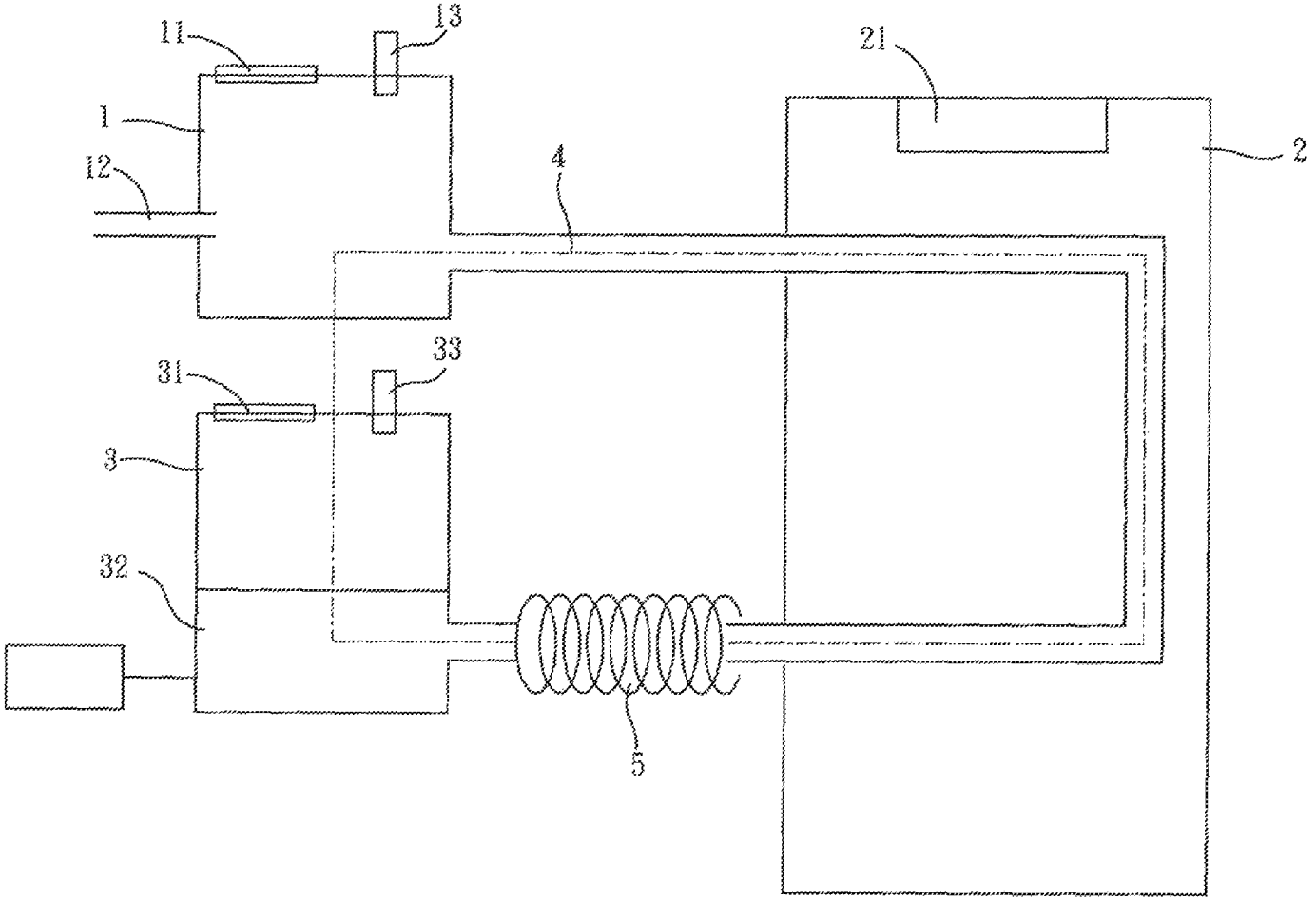
FIG. 1 is a diagram showing the architecture of the system of the invention.

FIG. 1 is a diagram showing the architecture of a metal particle manufacturing system of the invention. Referring to FIG. 1, the metal particle manufacturing system according to a preferred embodiment of the invention includes a first airtight container 1, a plasma melting chamber 2, a second airtight container 3 and a circulating conveyor belt 4.

The first airtight container 1 includes an inlet 11, an inert gas inlet 12 and a pressure relief valve 13. The inlet 11, in which a metal film may be placed, may be opened and hermetically closed. The air is pumped out of the first airtight container 1, and an inert gas is pumped into the first airtight container 1 through the inert gas inlet 12 in order to prevent the metal film from being oxidized. The pressure relief valve 13 provides a pressure relief function to prevent the pressure of the first airtight container 1 from getting too high.

A magnetron 21 for generating electromagnetic waves and serving as a plasma source is disposed in the plasma melting chamber 2 so as to melt the metal film into ultrafine particle metal. Also, in this embodiment, the magnetron 21 serving as the micro-wave plasma source is equipped with the circulating conveyor belt 4 to convey the ultrafine particle metal into the plasma melting chamber 2 for sintering and melting.

The second airtight container 3 includes an outlet 31, a cooling processor 32 and a pressure relief valve 33. The outlet 31, through which the ultrafine particle metal is taken out, may be opened and hermetically closed. The cooling processor 32 cools and suspends the ultrafine particle metal for collection. The pressure relief valve 33 provides a pressure relief function to prevent the pressure of the second airtight container from getting too high. In this embodiment, the cooling processor 32 is in the form of a container for holding a liquid, which may be pure water, alcohol or any other liquid with the similar function property, and functions to prevent the ultrafine particle metal from being reunited, wherein the circulating conveyor belt 4 may pass through the cooling processor 32 and provide the conveying function. In addition, a pump is provided to power the liquid into the circulating state.

Figure 2:
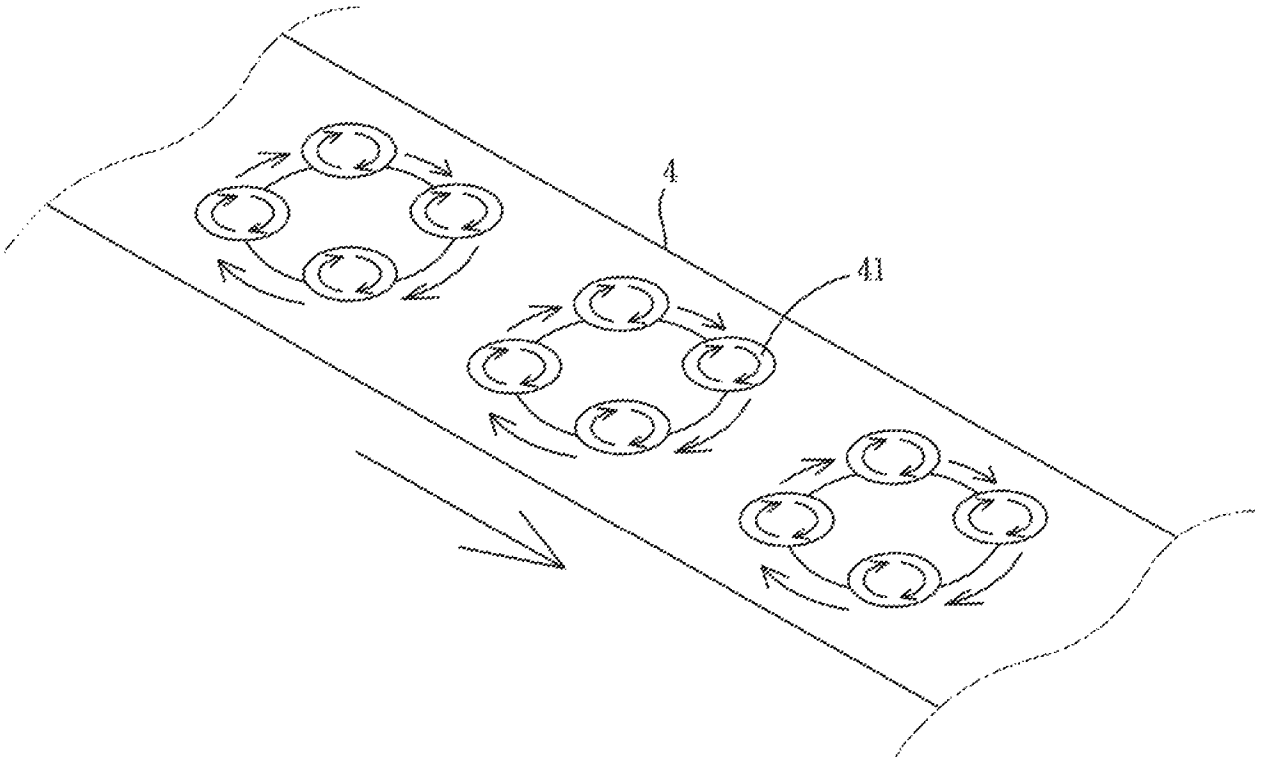
FIG. 2 is a partial structure diagram showing a conveyor belt according to FIG. 1.

The circulating conveyor belt 4 provides connections and conveying channels between the first airtight container 1, the plasma melting chamber 2 and the second airtight container 3, wherein airtight channels are provided to cover between the first airtight container 1, the plasma melting chamber 2 and the second airtight container 3. The circulating conveyor belt 4 may be in the form of multiple pipelines or self-rotating satellite disks 41 so that the metal film can be placed thereon to facilitate the uniform plasma melting processing (see FIG. 2).

In this embodiment, the first and second airtight containers 1 and 3, and the conveying channels between the first airtight container 1, the plasma melting chamber 2 and the second airtight container 3 are made of Teflon (Polytetrafluoroethene, PTFE).

A cooling tube 5 may be further disposed in the conveying channel between the plasma melting chamber 2 and the second airtight container 3, so that the ultrafine particle metal after the plasma processing can be subjected to two cooling processes to increase the cooling speed, and also to avoid the sudden pressure rise of the container caused by the water vapor formed by the ultrafine particle metal in the second airtight container 3 due to the direct cooling and heating.

Figure 3:
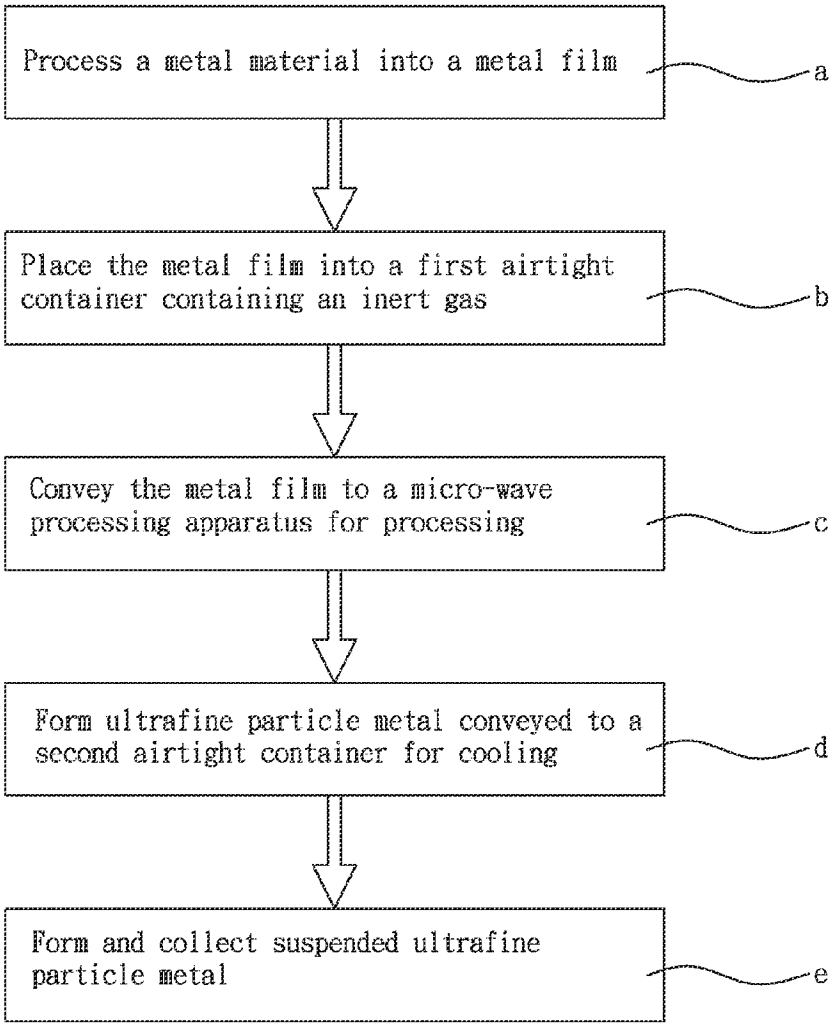
FIG. 3 is a flow chart of the invention.

Referring to FIG. 3, the method of manufacturing the metal material in the above-mentioned system includes the following step "a" to "e".

In the step "a", the metal material with the purity of 99.99% is processed by way of rolling, beating or vacuum evaporation to form the film state having the thickness smaller than 0.3 microns placed into the ultrapure water serving as a dispersant to avoid the stacking and gathering and the difficulty of separation.

In the step "b", the metal film is placed into the first airtight container 1 through the inlet 11 and is placed on and conveyed by the circulating conveyor belt 4, which may be in the form of multiple pipelines or may use the structure of the satellite disks 41. Meanwhile, the air in the first airtight container 1 is pumped out and replaced with the inert gas to prevent the metal film from being oxidized and control the pressure of the first airtight container 1 to be 20 psi lower than the pressure of the pressure relief valve.

In the step "c", the circulating conveyor belt 4 conveys the metal film into the plasma melting chamber 2, and the magnetron 21 serving as the plasma source is used to heat and sinter the surface of the metal film to generate the melted state to form the ultrafine particle metal. In addition, if the structure of the satellite disks 41 is adopted, the self-rotating enables the metal film to be subjected to the more uniform plasma sintering action.

In the step "d", the ultrafine particle metal generated after the plasma processing is conveyed, by the circulating conveyor belt 4, into the second airtight container 3. After the cooling of the cooling tube 5, the ultrafine particle metal is suspended in the liquid so that the ultrafine particle metal can be collected. Also, when the ultrafine particle metal that is just melted is cooled, the water vapor is formed in the second airtight container 3 to increase the pressure. At this time, the pressure relief valve 33 thereof can be used to perform the suitable pressure relief.

In the step "e", the ultrafine particle metal, which has passed the cooling processor 32 and been cooled, is collected to obtain the required ultrafine particle metal.

According to the above-mentioned description, it is obtained that the invention firstly processes the metal material by way of rolling, beating or vacuum evaporation to form the film state having the thickness smaller than 0.3 microns (the submicron level) to manufacture the metal particle. Thus, the subsequent formation process of processing the ultrafine particle metal becomes simpler and more convenient. More particularly, the overall processes are performed in the airtight state without being affected by the external factor. Furthermore, the pure water, alcohol or any other liquid with the similar function property is used as the dispersant to avoid the reuniting. Meanwhile, the plasma heating is used to sinter and melt the metal film so that the highly pure ultrafine particle metal particle with the less impurity than the prior art can be obtained.

In summary, the invention can indeed achieve the above-mentioned object and effect, and has overstepped the existing art.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A metal particle manufacturing system, comprising:

a first airtight container having an inlet and an inert gas inlet, wherein the inlet, through which a metal film may pass, may be opened and hermetically closed, air is pumped out of the first airtight container through the inert gas inlet, and an inert gas is pumped into the first airtight container through the inert gas inlet;

a plasma melting chamber, in which a magnetron for generating heat by micro-waves is disposed to melt the metal film into ultrafine particle metal;

a second airtight container having an outlet and a cooling processor, wherein the outlet, through which the ultrafine particle metal is taken out, may be opened and hermetically closed, and the cooling processor is in the form of a container for holding a liquid and is equipped with a pump for pumping the liquid into a circulating state to cool the liquid and suspend the ultrafine particle metal for collection; and a circulating conveyor belt for providing connections runs within airtight conveying channels between the first airtight container, the plasma melting chamber and the second airtight container, wherein the airtight channels are provided to cover between the first airtight container, the plasma melting chamber and the second airtight container.

2. The system according to claim 1, wherein a pressure relief valve for providing a pressure relief function is disposed in the first airtight container.

3. The system according to claim 1, wherein a pressure relief valve for providing a pressure relief function is disposed in the second airtight container.

4. The system according to claim 1, wherein the liquid held in the cooling processor is pure water or alcohol.

5. The system according to claim 1, wherein the circulating conveyor belt contains self-rotating satellite disks.

6. The system according to claim 1, wherein the first and second airtight containers, and the conveying channels between the first airtight container, the plasma melting chamber and the second airtight container are made of polytetrafluoroethene (PTFE).

7. The system according to claim 1, wherein a cooling tube is disposed in the conveying channel between the plasma melting chamber and the second airtight container.

8. The system according to claim 1, wherein the airtight channels are in the form of multiple pipelines, each channel containing a circulating conveyor belt.

* * * * *